US005541459A

United States Patent [19]

Jonsson et al.

[11] Patent Number: 5,541,459

[45] Date of Patent: Jul. 30, 1996

[54] DEVICE FOR COMPENSATION OF AN ALTERNATING VOLTAGE WHICH OCCURS BETWEEN A MEDIUM AND A METALLIC PIPELINE DISPOSED IN THE MEDIUM

[75] Inventors: Uno Jonsson, Vällingby; Dan Karlsson, Ludvika, both of Sweden

[73] Assignee: STRI AB, Ludvika, Sweden

[21] Appl. No.: 290,924

[22] PCT Filed: Mar. 4, 1993

[86] PCT No.: PCT/SE93/00187

§ 371 Date: Aug. 23, 1994

§ 102(e) Date: Aug. 23, 1994

[87] PCT Pub. No.: WO93/18204

PCT Pub. Date: Sep. 16, 1993

[30] Foreign Application Priority Data

Mar. 5, 1992 [SE] Sweden ..... 9200671

[51] Int. Cl.[6] ..... C23F 13/06; H01B 7/28

[52] U.S. Cl. ..... 307/95; 204/196

[58] Field of Search ..... 307/95, 101, 89–91, 307/104, 17, 83; 336/84 R, 84 C, 84 M, 87; 174/32–34, 36; 204/404, 196, 147; 361/149, 107, 108; 405/157; 333/12

[56] References Cited

U.S. PATENT DOCUMENTS

| | | | |
|---|---|---|---|
| 1,962,696 | 6/1934 | Rhodes | 307/95 |
| 2,053,214 | 9/1936 | Brown | 307/95 |
| 2,483,397 | 10/1949 | Bonner | 307/95 |
| 2,862,177 | 11/1958 | Titterington | 307/95 |
| 2,893,939 | 7/1959 | Reid | 204/196 |
| 4,219,807 | 8/1980 | Speck et al. | 307/95 |
| 5,126,654 | 6/1992 | Murphy et al. | 204/196 |

*Primary Examiner*—William M. Shoop, Jr.
*Assistant Examiner*—Richard T. Elms
*Attorney, Agent, or Firm*—Watson, Cole, Grindle & Watson

[57] ABSTRACT

In a metallic pipeline (1) disposed in the ground, voltages may be induced from adjacent transmission lines and cause corrosion. To reduce the risk of corrosion, voltages are induced in the pipeline with the aid of a transformer (8), which voltages counteract the induced voltages. A measuring conductor (2) provides a signal which is a measure of the induced voltage. In a suitable way, this signal controls the amplitude and phase position of a voltage ($U_1$) which is generated by a converter coupling (7) and is applied to the primary winding of the transformer (8). (FIG. 1*a*)

10 Claims, 5 Drawing Sheets

DEVICE FOR COMPENSATION OF AN ALTERNATING VOLTAGE WHICH OCCURS BETWEEN A MEDIUM AND A METALLIC PIPELINE DISPOSED IN THE MEDIUM

TECHNICAL FIELD

The invention relates to a device for compensation of an alternating voltage which occurs between a medium and a metallic pipeline disposed in the medium, the pipeline being surrounded by a layer (mantle) of electrically insulating material.

BACKGROUND ART

In case of parallelism between a.c. transmission lines and metal pipes for, for example, natural gas, the normal operating current of the transmission line induces a voltage in the metal pipe. For example, from a 400 kV line with an operating current of 1000 A at a distance of 50 m from the pipeline, an induced voltage of about 20 V/km can be obtained.

A metal pipe of the above kind may, for example, constitute part of a long gas conduit, which is disposed in the ground and possibly partially also in water. A conduit of this kind is usually divided into sections with the aid of electrically insulating joints. The length of one section may vary from several kilometers up to several tens of kilometers. If a transmission line runs parallel to such a line for a distance of some length, induced voltages of a considerable magnitude may therefore occur.

When the alternating voltage between the pipe and the surrounding ground (water) exceeds a few tens of volts, this may entail an increased risk of corrosion damage to the pipeline because of electrolytic corrosion. Metal pipes of the kind in question are provided with a protective coating of an electrically insulating material. However, damage unavoidably arises in this coating, whereby the metal pipe is brought into electrical contact with the surrounding medium. At these points the above-mentioned risk of corrosion occurs.

Different types of measures for protection against corrosion are previously known. However, these do not provide any protection against the risk of corrosion which is caused by alternating voltages induced in a pipeline.

SUMMARY OF THE INVENTION

The invention aims to provide a device which, in a simple and advantageous manner, provides good protection against the risks of corrosion which, in pipelines of the kind mentioned in the introduction, are caused by alternating voltages induced in the pipelines.

What characterizes a device according to the invention will become clear from the appended claims.

BRIEF DESCRIPTION OF THE DRAWINGS

The invention will be described in greater detail with reference to the accompanying FIGS. 1–5, wherein FIGS. 1*a*–1*c* show an example of a device according to the invention, wherein FIG. 1*a* shows a general diagram of the device, FIG. 1*b* shows the transformer included in the device and the location of the transformer around the pipeline, and FIG. 1*c* illustrates the reduction of the voltage between the pipeline and the surrounding medium which can be obtained with the aid of the device shown in FIG. 1*a* and FIG. 1*b*.

DESCRIPTION OF THE PREFERRED EMBODIMENTS

Figure 1A:
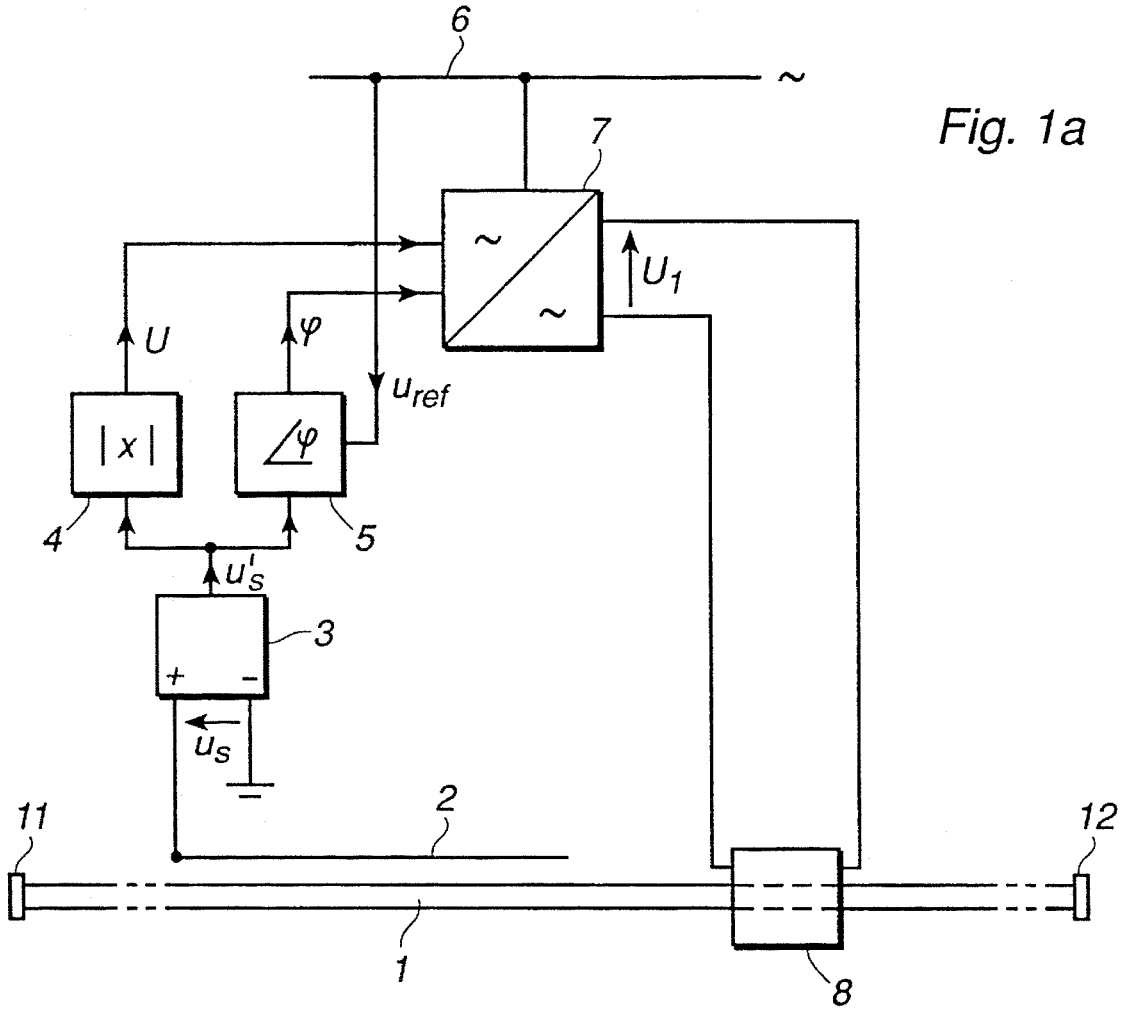

FIG. 1*a* shows an elementary diagram of a piece of equipment according to the invention. The figure shows a section 1 of a metallic natural gas conduit 1 disposed in the ground, the conduit being provided with an electrically insulating coating and being electrically insulated from adjoining pipe sections with the aid of electrically insulating joints 11 and 12. To provide a measure of the alternating voltage which can be induced in the section 1 by electric transmission lines, which extend in the vicinity of and wholly or partially parallel to the pipe section, a measuring conductor 2 insulated from ground is arranged. This conductor may be arranged in the ground, on the ground or above the ground. The measuring conductor 2 is suitably arranged parallel to the pipeline and close to the pipeline. The length of the measuring conductor may be small in relation to the length of the section 1, but if desirable for obtaining a sufficient magnitude of the measured signal from the conductor, the length of the conductor may constitute a considerable part of the length of the section. The conductor 2 may be grounded at a suitable point. The voltage $u_s$ induced in the conductor 2 is supplied to an instrumentation amplifier 3, the output signal of which is designated $u'_s$. Due to the location of the measuring conductor 2 parallel to and close to the pipe section 1, the signals $u_s$ and $u'_s$ become a good measure of the voltage induced in the pipe section by the operating current of the transmission line. The signal $u'_s$ from the instrumentation amplifier 3 is supplied to an absolute value generator 4 and a phase detector 5. The absolute value generator 4 delivers a signal U which is proportional to the amplitude of the voltage $u_s$ induced in the measuring conductor 2. The phase detector 5 delivers a signal $\phi$ which is proportional to the phase difference between the signal $u'_s$ and a reference voltage $u_{ref}$. The reference signal is an alternating signal with the same frequency as the frequency in the transmission line which causes the voltages induced in the pipeline. As shown in the figure, the reference voltage can be obtained in the simplest manner from a local network 6, which belongs to the same power network as the above-mentioned transmission line and therefore has the same frequency as this.

The signals U and $\phi$ are supplied to a controller 7, which is adapted to supply an alternating voltage $U_1$ with controllable amplitude and with controllable phase position. As shown in FIG. 1*a*, the controller 7 may consist of an alternating voltage converter, for example an intermediate link converter with a controllable rectifier supplied from the network 6, a direct voltage intermediate link, and a self-commutated inverter adapted to supply an alternating voltage with controllable frequency and hence with controllable phase position. With this embodiment of the controller 7, the voltage U is adapted to control the intermediate link direct voltage and hence the amplitude of the voltage $U_1$, and the signal $\phi$ is adapted to control the inverter such that the voltage $U_1$ assumes a phase position $\phi_1=\phi+\pi$ in relation to the reference voltage, that is, the voltage $U_1$ is in phase opposition to the measured signal $u_s$.

Figure 1B:
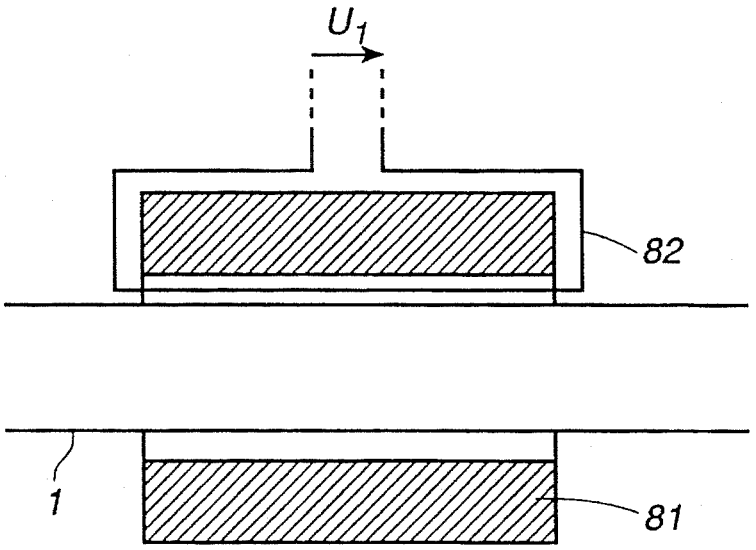

The voltage $U_1$ generated by the controller 7 is supplied to a transformer 8. As shown in more detail in FIG. 1*b*, this transformer has an iron core 81 with an annular or rectangular cross section, which surrounds the pipeline 1. The iron core is suitably made of oriented sheet metal and can be made wound from one single coherent strip of sheet. Alternatively, the core may consist of a number of composite sheets with their planes perpendicular to the longitudinal axis of the pipeline. As schematically shown in FIG. 1*b*, a primary winding 82 is applied on the core, the voltage $U_1$ from the controller 7 being connected to this primary winding. The winding 82 and the controller 7 are designed such that suitable current and voltage levels are obtained. For example, the winding 82 may consist of ten turns, the voltage $U_1$ have a root-mean square (RMS) value of the order of magnitude of 100 V, and the current through the primary winding of the transformer have an RMS of about 13 A.

The pipeline 1 functions as a single-turn secondary winding to the transformer 8, and an EMF $E_2=U_1/N_1=k.U/N_1$ is induced in the pipeline. As will be clear from the foregoing, this EMF is in phase opposition to the EMF induced in the pipeline by the transmission line. Thus, these two EMFs will counteract each other, and if the equipment according to the invention is correctly designed and adjusted, an almost complete suppression of the voltages induced in the pipeline 1 by the transmission line current can be obtained. The constant k in the expression above is chosen and adjusted in the control system such that the desired degree of suppression is obtained of the voltage induced in the pipeline. The constant k can be determined by calculation, measurement or by practical tests.

If considered necessary, the signal from the measuring conductor 2 can be filtered in a band-pass filter tuned to the frequency of the transmission line, this in order to eliminate the effect of voltages occurring in the measuring conductor and emanating from other sources than the transmission line.

Figure 1C:
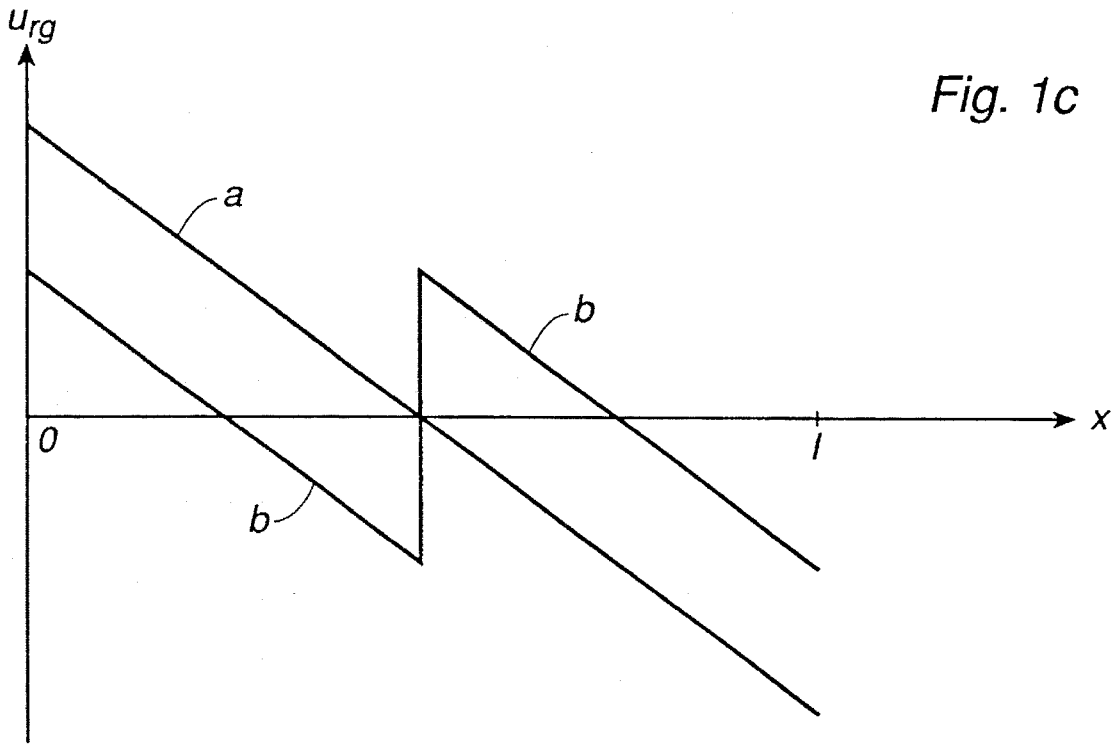

FIG. 1*c* shows the voltage in the pipeline in relation to ground plotted against the distance x from one end of the line section. The section is assumed to have the length 1 and be grounded at its centre, for example through damage to the electrical insulation of the line. The curve designated a in the figure shows the voltage which would be caused by a transmission line extending in parallel with the line section along the whole of its length. The voltage assumes a maximum value $\pm u_m$ at the end points of the section. If a transformer 8 according to the invention is arranged at the centre of the line section and adapted to induce in the pipeline an EMF of the magnitude $u_m$, the voltage will have an appearance as shown by the curve b. As will be clear from the figure, the maximum voltage between the pipeline and ground is reduced by a factor 2.

Figure 2A:
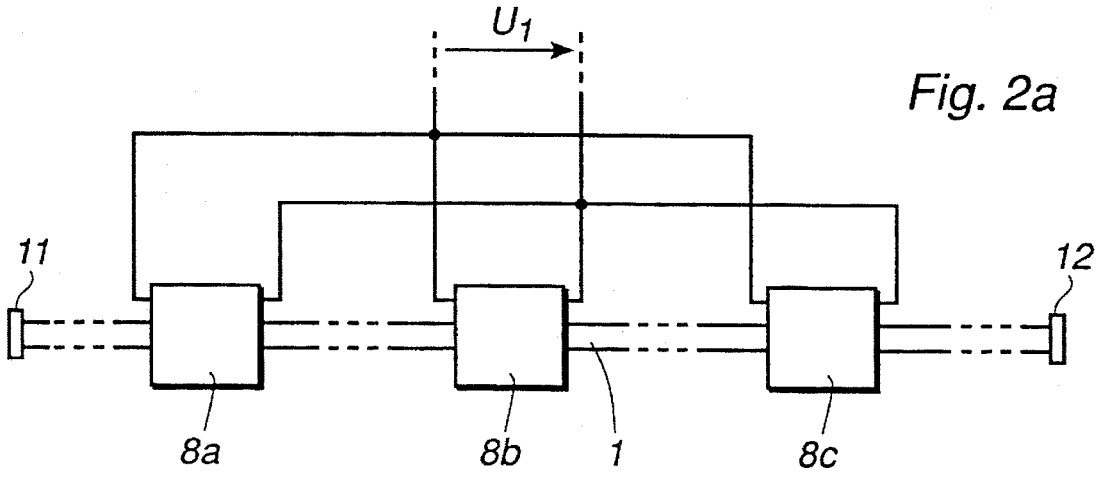
FIG. 2*a* shows how, in equipment according to the invention, several transformers can be arranged along a section of the pipeline.
Figure 2B:
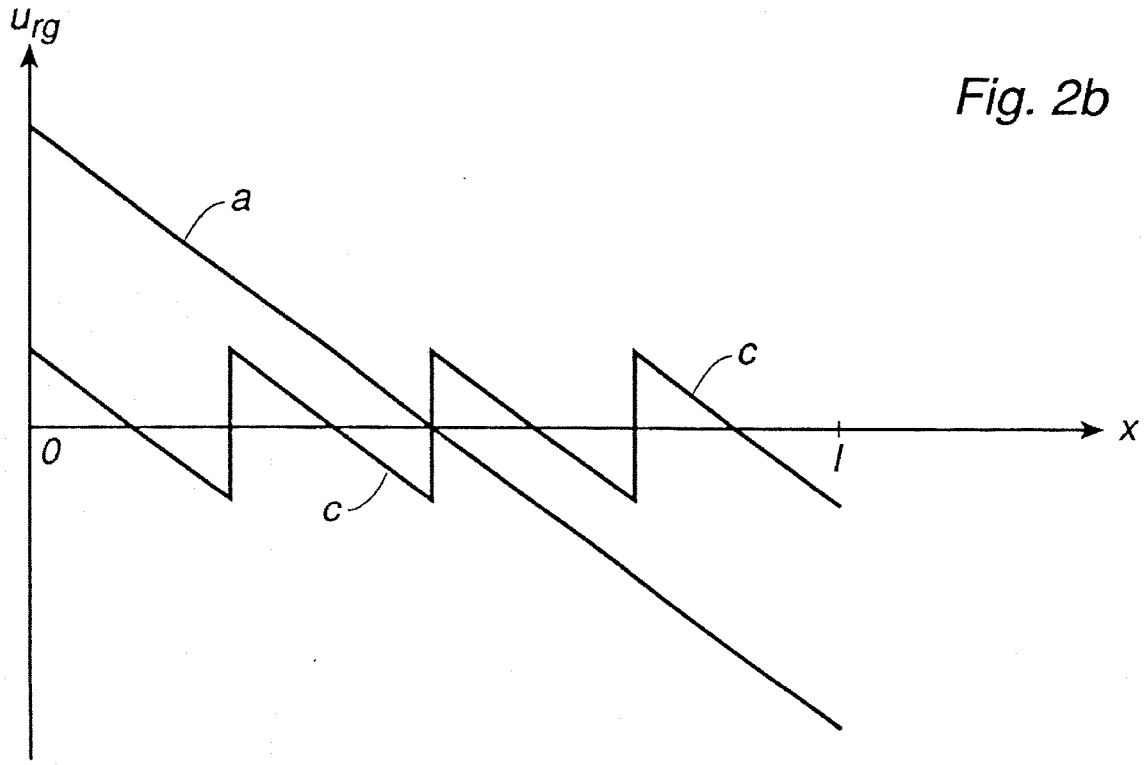
FIG. 2*b* shows the reduction of the voltage between the pipeline and ground which can be obtained in this way.

If this reduction is not considered sufficient, a further reduction can be obtained by arranging a number of transformers according to the invention along the line section. FIG. 2*a* shows such an example where three transformers 8*a*, 8*b* and 8*c* are arranged evenly distributed along the length of the section. The primary windings of the transformers are connected in parallel to the controller 7 and are thus supplied with the voltage $U_1$. In FIG. 2*b*, the curve c shows the voltage which is obtained between the pipeline and ground. As is clear, in this case a reduction of the maximum voltage by a factor of 4 is obtained.

Figure 3:
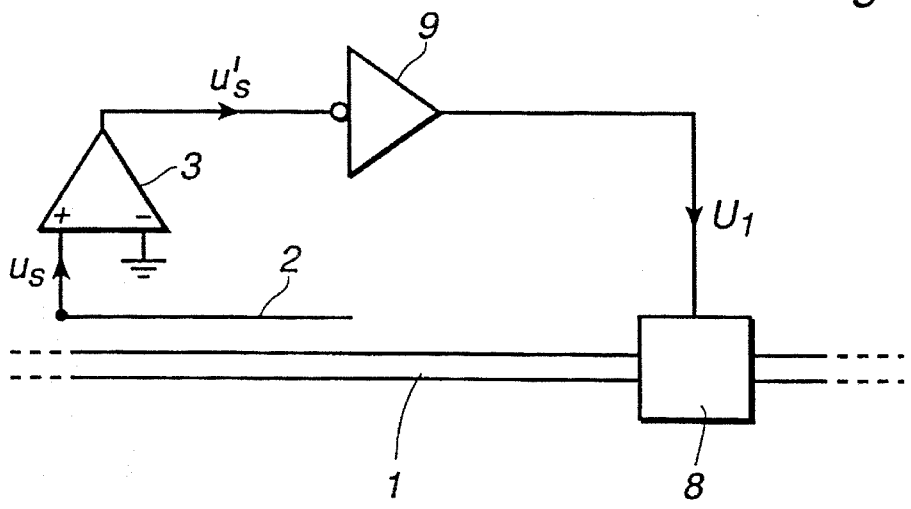
FIG. 3 shows an alternative embodiment in which the transformer included in the device is supplied from a power amplifier.

FIG. 3 shows an alternative embodiment of the equipment according to the invention. The signal $u'_s$ from the instrumentation amplifier 3 is supplied to a sign-reversing power amplifier 9, the output signal $U_1$ of which is supplied to the transformer 8. By the sign reversal in the amplifier 9, the signal $U_1$ will be in phase opposition to the signal $u'_s$ and by a suitable adjustment of the amplification factor of the amplifier, in principle a complete suppression of the voltages induced in the pipeline 1 can be obtained. The amplifier 9 may, for example, be a switched power amplifier of a kind known per se.

Figure 4:
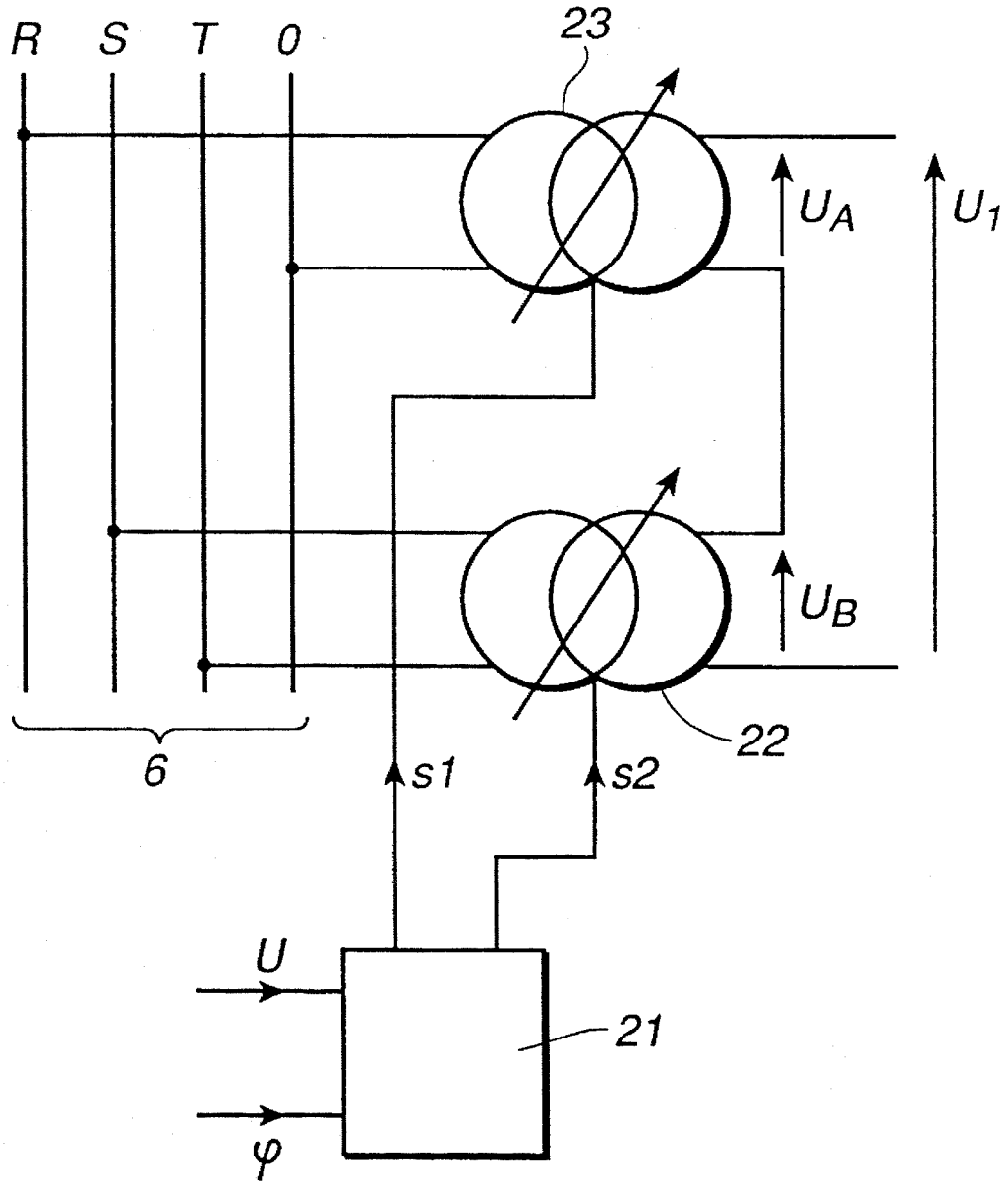
FIG. 4 shows how a controllable transformer coupling can be used as an alternative for supply of the transformer of the equipment.

FIG. 4 shows how, as an alternative, a transformer coupling can be used for generating the supply voltage to the transformer 8. The coupling comprises two single-phase transformers 22 and 23. The transformer 22 has its primary winding connected to the phases S and T of the local network 6, and the transformer 23 has its primary winding connected between the phase R and the neutral line 0 of the network. The amplitude of the output voltage of each transformer is controllable, continuously or in steps. The transformers may, for example, consist of servo-motor operated adjustable transformers or of transformers which are provided with tap changers. In the coupling shown, the output voltage $U_A$ from the transformer 23 will have a phase shift of 90° in relation to the output voltage $U_B$ from the transformer 22. Since the secondary windings of the two transformers are connected in series, their output voltages will be added vectorially, and their vector sum constitutes the supply voltage $U_1$ to the transformer 8. If the output voltage of each transformer can be varied from maximum amplitude in one phase position to maximum amplitude in the opposite phase position, the output voltage $U_1$ may in a known manner be controlled arbitrarily both with respect to amplitude and phase position within all four quadrants. For control of the transformers, the signals U and $\phi$ (see FIG. 1*a*) are supplied to a control unit 21, which delivers control signals s1 and s2 to the actuators of the transformers. The control device may, for example, deliver such control signals s1 and s2 to the transformers that the output voltages thereof become:

$$U_A=U\sin(\phi+\pi)$$

$$U_A=U\cos(\phi+\pi)$$

In this way, the supply voltage to the transformer 8 will have the amplitude U and a phase position which is in opposition to the alternating voltage induced in the pipeline 1.

Figure 5A:
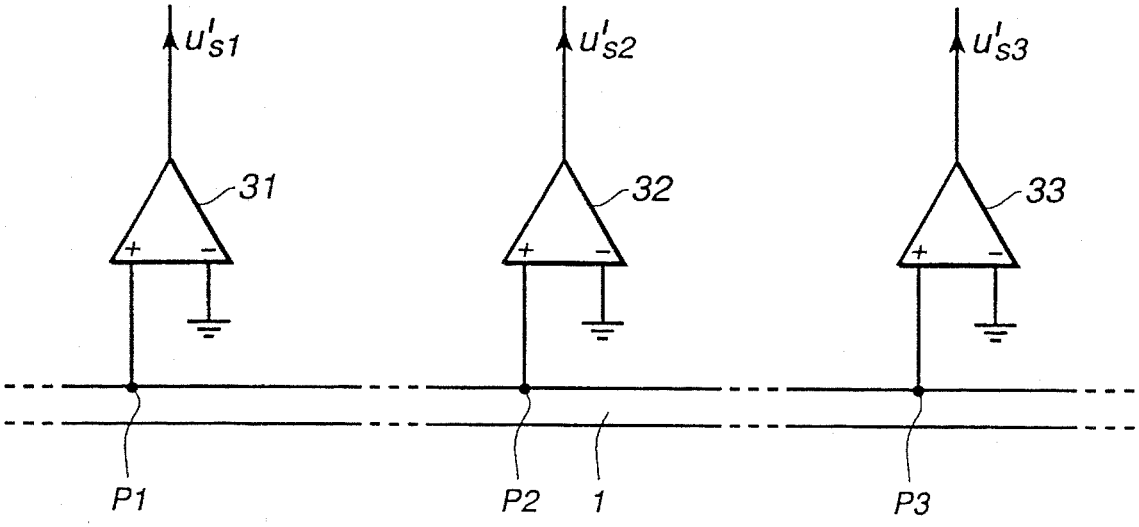
FIGS. 5*a* and 5*b* show an alternative method for sensing the voltage induced in the pipeline and for controlling the supply voltage to the transformer included in the equipment.
Figure 5B:
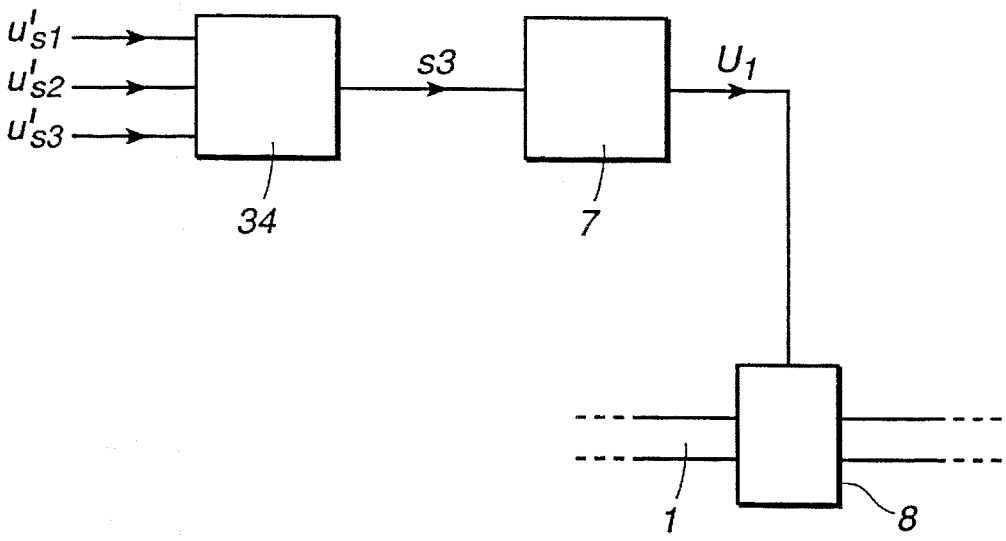

The control of the equipment according to the invention can be carried out in other ways than the one described above. For example, as shown in FIG. 5*a*, the voltage between the pipeline and ground may be sensed at one or a plurality of points distributed along the pipeline. In the example of FIG. 5*a*, this is done by connecting instrumentation amplifiers 31, 32, 33 between ground and the points P12, P2, P3 on the pipeline. The output signals $u'_{s1}$, $u'_{s2}$, $u'_{s3}$ of the instrumentation amplifier are supplied to an optimization unit 34 (FIG. 5*b*). This, in turn, delivers a control signal s3 to the controller 7. The control signal s3 influences the amplitude and phase position of the voltage $U_1$ generated by the controller, which voltage is supplied to the transformer 8. The optimization unit 34 may, for example, consist of a suitably programmed computer adapted to influence the voltage $U_1$ via the control signal s3 in such a way in dependence on the measured signals that the risk of corrosion of the pipeline is minimized. The optimization unit may, for example, form the mean value of the measured signals and by successive attempts vary the amplitude and phase position of the voltage $U_1$ until this mean value reaches a minimum. Instead of minimizing the mean value of the measured signals as described above, it is, of course, possible to form and minimize some other quantity representative of the risk of corrosion. As an alternative example, the quantity which is minimized can consist of that of the measured signals which has the greatest absolute value.

The input signal or signals to the optimization unit 34 in FIG. 5*b* need not, of course, be formed in the manner shown in FIG. 5*a*. In an alternative embodiment, for example, the input signals to the optimization unit may consist of the measured signal or signals from one or more measuring conductors 2 of the kind shown in FIG. 1.

FIG. 2*a* shows how several transformers, supplied from a common voltage source, can be disposed along the pipeline section in question to achieve a greater reduction of the induced voltages. Alternatively, the same effect can be attained by placing several complete pieces of equipment of the kind shown in FIG. 1*a* along the pipeline section.

The measuring conductors 2 shown in FIGS. 1 and 3 constitute one way of forming a quantity which is a measure of the voltage induced in the pipeline. Also other ways are feasible. As mentioned, the voltage induced in the pipeline is, with respect to magnitude and phase position, directly dependent on the load current of the transmission line. Where it is possible and suitable to measure this current, it can be used directly as a measure of the voltage induced in the pipeline.

In the above description, it has been implicitly assumed that the load current in the transmission line, and hence the voltage induced in the pipeline, is a pure sine wave current without harmonics. In practice, harmonics may occur in the load current and induce alternating voltages of corresponding frequencies in the pipeline, which voltages, in the same way as the fundamental component, may cause risks of corrosion. The embodiment of the invention shown in FIG. 3 will automatically entail a compensation also of induced harmonics, since the voltage $U_1$ applied to the transformer constitutes a sign-reversed reproduction of the measured signal $u_s$ obtained from the measuring conductor 2. Harmonics in the induced voltage may, of course, be compensated for also in other ways. Thus, for example, both the fundamental component and the harmonics in question may be separated out of the measured signal with the aid of the band-pass filter and be determined individually in amplitude and phase position, whereupon the desired voltage $U_1$ for suppressing all the sensed components are synthetized in a suitable way with the aid of suitable electronic circuits.

As an alternative to the converter coupling 7 shown in FIG. 1 and to the transformer coupling shown in FIG. 4, a cascade connection of an induction regulator and an adjustable transformer can be used, the induction regulator being used for controlling the phase position of the supply voltage to the transformer 8 and the adjustable transformer being used for controlling the amplitude of the voltage.

We claim:

1. A device for compensation of an alternating voltage which occurs between a medium and a metallic pipeline disposed in the medium, said pipeline being surrounded by a layer of electrically insulating material, the device comprises a) a transformer with a core surrounding the pipeline and with a winding applied on the core, b) first members forming a quantity which corresponds to the alternating voltage occurring in the pipeline, and c) voltage-generating members supplied with said quantity, to generate, in dependence thereon, an alternating voltage and to supply this voltage to the transformer winding such that the voltage between the medium and the pipeline reduces the risk of corrosion of the pipeline.

2. A device according to claim 1, wherein said first members comprise a measuring conductor disposed substantially parallel to the pipeline, and said quantity is formed from the voltage induced in the measuring conductor.

3. A device according to claim 2, wherein said first members comprise amplitude-sensing members forming an amplitude signal corresponding to the amplitude of the induced voltage, as well as phase-angle sensing members forming a phase position signal corresponding to the phase position of the induced voltage, which signals are supplied to said voltage-generating member, which in turn generates and supplies the transformer with a voltage with an amplitude corresponding to the amplitude signal and a phase position corresponding to the phase position signal.

4. A device according to claim 3, wherein said phase-angle sensing members form the phase position signal in dependence on the phase position of the voltage induced in the measuring conductor in relation to a reference alternating voltage, and said voltage-generating member generates an alternating voltage with the same frequency as the reference voltage and with a phase position, in relation to the reference voltage, which is dependent on the phase position signal.

5. A device according to claim 1, wherein said first members comprise members for sensing the voltage between the pipeline and the surrounding medium at least one of a plurality of points along the pipeline and, in dependence on the sensed voltage values, to form a control quantity for controlling the voltage-generating member.

6. A device according to claim 1, further comprising a plurality of transformers distributed along the pipeline.

7. A device according to claim 6, wherein the transformers are supplied from a common voltage source.

8. A device according to claim 1, wherein the voltage-generating member consists of a power amplifier.

9. A device according to claim 1, wherein the voltage-generating member consists of a voltage converter.

10. A device according to claim 1, wherein the voltage-generating member consists of a controllable transformer coupling.

* * * * *